US011098558B2

(12) United States Patent
Brown et al.

(10) Patent No.: US 11,098,558 B2
(45) Date of Patent: Aug. 24, 2021

(54) INJECTION VALVE ARRANGEMENT WITH SWITCHED BYPASS AND METHOD

(71) Applicants: Donavan Holland Brown, Houston, TX (US); Keith J. Murphy, Hartford, CT (US)

(72) Inventors: Donavan Holland Brown, Houston, TX (US); Keith J. Murphy, Hartford, CT (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/425,273

(22) Filed: May 29, 2019

(65) Prior Publication Data

US 2020/0378215 A1 Dec. 3, 2020

(51) Int. Cl.

| | |
|---|---|
| ***E21B 34/10*** | (2006.01) |
| ***E21B 34/08*** | (2006.01) |
| ***E21B 21/08*** | (2006.01) |
| ***E21B 21/10*** | (2006.01) |

(52) U.S. Cl.

CPC ..... *E21B 34/10* (2013.01); *E21B 21/08* (2013.01); *E21B 21/10* (2013.01); *E21B 34/08* (2013.01); *E21B 21/103* (2013.01)

(58) Field of Classification Search

CPC ..... E21B 21/08; E21B 21/10; E21B 21/103; E21B 34/00; E21B 34/101; E21B 34/08

See application file for complete search history.

(56) References Cited

U.S. PATENT DOCUMENTS

| | | | | |
|---|---|---|---|---|
| 6,173,768 | B1 * | 1/2001 | Watson | E21B 34/06 166/105.5 |
| 2008/0093078 | A1 * | 4/2008 | Vasques | E21B 49/08 166/311 |
| 2009/0095528 | A1 | 4/2009 | Hay et al. | |
| 2010/0175873 | A1 * | 7/2010 | Milkovisch | G01N 1/24 166/264 |
| 2010/0212910 | A1 * | 8/2010 | James | F15B 11/13 166/373 |
| 2011/0203809 | A1 * | 8/2011 | Knobloch, Jr. | E21B 34/14 166/386 |
| 2012/0006563 | A1 | 1/2012 | Patel et al. | |
| 2012/0012327 | A1 | 1/2012 | Plunkett et al. | |
| 2016/0273321 | A1 | 9/2016 | Frosell et al. | |

(Continued)

OTHER PUBLICATIONS

Notification of Transmittal of the International Search Report and the Written Opinion of the International Searching Authority, or the Declaration; PCT/US2020/028711; dated Jul. 29, 2020; 11 pages.

*Primary Examiner* — Tara Schimpf
(74) *Attorney, Agent, or Firm* — Cantor Colburn LLP

(57) ABSTRACT

An embodiment of an injection arrangement including a principal fluid pathway having a first check valve; a bypass pathway fluidly connected to the principal fluid pathway upstream of the first check valve and connected to the principal fluid pathway downstream of the first check valve. Also a method for injecting a fluid including supplying an injection fluid to an injection arrangement as in any prior embodiment; flowing fluid through the bypass pathway; preventing fluid flow through the bypass pathway; and then flowing fluid through the principal fluid pathway.

15 Claims, 3 Drawing Sheets

(56) References Cited

U.S. PATENT DOCUMENTS

| | | | | |
|---|---|---|---|---|
| 2016/0281463 | A1 | 9/2016 | Patel | |
| 2017/0175521 | A1* | 6/2017 | Pirolli | E21B 49/08 |
| 2020/0190943 | A1* | 6/2020 | Clayton | E21B 34/10 |

* cited by examiner

INJECTION VALVE ARRANGEMENT WITH SWITCHED BYPASS AND METHOD

BACKGROUND

In the resource recovery industry it is often desirable to inject fluids into a subsurface environment for various reasons. Common concerns include the hydrostatic pressures at injection sites. Specifically, it is often desirable or required to ensure that fluids in a production string for example do not lift a column of to be injected fluid due to produced fluid pressure being greater than the hydrostatic pressure of the to be injected fluid. Conversely, it is also desirable or required that to be injected fluids are not lost to the formation when hydrostatic pressure in the to be injected fluid exceeds produced fluid pressure. It is to be understood that the above is exemplary only and the disclosure hereof is applicable to any situation where the pressure of a volume that is to receive injected fluids is higher or lower than the pressure of the to be injected fluid.

The art would well receive new arrangements that address the issue.

SUMMARY

An embodiment of an injection arrangement including a principal fluid pathway having a first check valve; a bypass pathway fluidly connected to the principal fluid pathway upstream of the first check valve and connected to the principal fluid pathway downstream of the first check valve.

Also a method for injecting a fluid including supplying an injection fluid to an injection arrangement as in any prior embodiment; flowing fluid through the bypass pathway; preventing fluid flow through the bypass pathway; and then flowing fluid through the principal fluid pathway.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
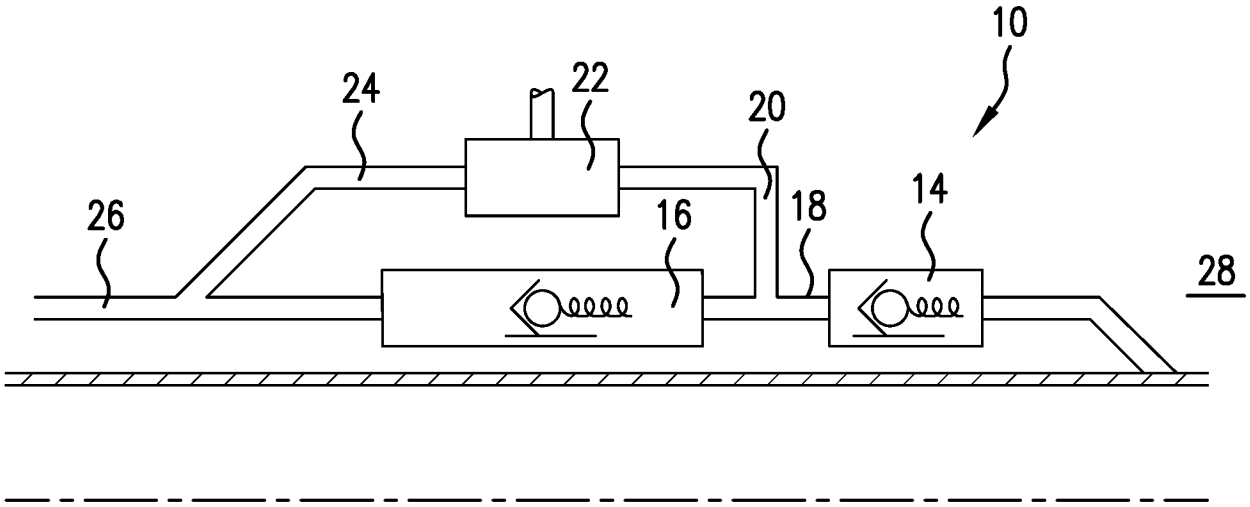
FIG. 1 is a schematic illustration of an injection valve arrangement with switched bypass as disclosed herein.

Referring to FIG. 1 an injection arrangement 10 is disposed for purposes of description on a tubular 12 such as a tubing string in a hydrocarbon bearing formation. It will be appreciated that the concept disclosed herein can be applied to other industries and situations where injection of one fluid is desired into another fluid having differing pressure. Also just for purposes of discussion the injection arrangement may be part of a chemical injection system and components may be described using that terminology, without limitation. The arrangement 10 includes a principal fluid pathway 6 and a bypass pathway 8. In an embodiment a check valve 14 and another check valve 16 are disposed in the principal fluid pathway 6. Between the two check valves 14 and 16 and as a part of the principal fluid pathway 6 is a conduit 18 that is accessible to a bypass rejoin line 20 that is a part of the bypass pathway 8. Fluid bypassing the valve 16 in the bypass pathway 8 of the arrangement 10 is then passed through the valve 14 for injection into the volume into which the fluid is desired to be injected, in this case into the volume defined within the tubular 12. The bypass pathway 8 of arrangement 10 comprises a bypass supply 24 (connected to the supply 26 that supplies injection fluid to the principal fluid pathway 6), a switch 22 that either allows or prevents fluid movement through the bypass pathway 8 and the bypass rejoin line 20 noted above. The switch 22 may be configured in a number of ways to ensure that the valve 16 is bypassed under certain conditions and not bypassed in other conditions of the tubular 12. In an embodiment, the conditions that dictate or proscribe bypass are pressure conditions. For example, in a hydrocarbon production situation, the pressure in the tubular 12 may be high at an earlier part of the lifetime of the well and lower toward end of life of the well. At no time during the life of the well should production fluid be allowed to enter the arrangement 10 or the injection fluid source 26. Likewise however, at no time should an uncontrolled loss of injection fluid escape the arrangement 10 and run into the formation. Accordingly, valve 14 is configured to prevent the noted infiltration and valve 16 is configured to prevent the loss of injection fluid. Addressing the valve 14 first, this is generally an important part of arrangement 10 during the higher pressure time of the well. Since at this time, formation pressure is likely to exceed the hydrostatic pressure of the injection fluid, were it not for valve 14, wellbore fluid would lift the column of injection fluid and infiltration into the arrangement 10 would ensue. Later in the life of the well, as pressure is depleted in the reservoir in which the well is disposed, the need for valve 14 is much less while valve 16 becomes more important in order to prevent the injection fluid running into the well. This can happen when the hydrostatic pressure of the injection fluid exceeds the pressure of the production fluid in the tubular 12. Losing chemicals to the formation is expensive and therefore undesirable. Hence the valve 16 has been used. In order for the valve 16 to function, its biasing member must be strong enough to hold up the entire hydrostatic load of the injection fluid. To cause fluid to inject therepast requires pressure added to the injection line greater than the production pressure in addition to the biasing member. Early in the life of the well, this means an operator must apply significant pressure to inject fluid (because formation pressure early in the life of the well is substantial). The arrangement 10 avoids the need for very high injection pressures by providing the bypass components 20-24 in bypass pathway 8. Fluid from source 26 may bypass the valve 16 if the switch 22 is open to flow. The switch 22 is actuable automatically based upon pressure in the tubular 12 or annulus 28 about the tubular 12 (embodiment of FIG. 2), by a selective chemical supplied through the line 24 at a selected time (embodiment of FIG. 3) or by releasing a plug through the line 24 at a selected time (embodiment of FIG. 4). In each case, the arrangement 10 will allow injection of fluid at lower pressures by bypassing the valve 16 during times when pressure in the tubular 12 is high and by actuating the valve 16 when pressures in tubular 12 are low.

Figure 2:
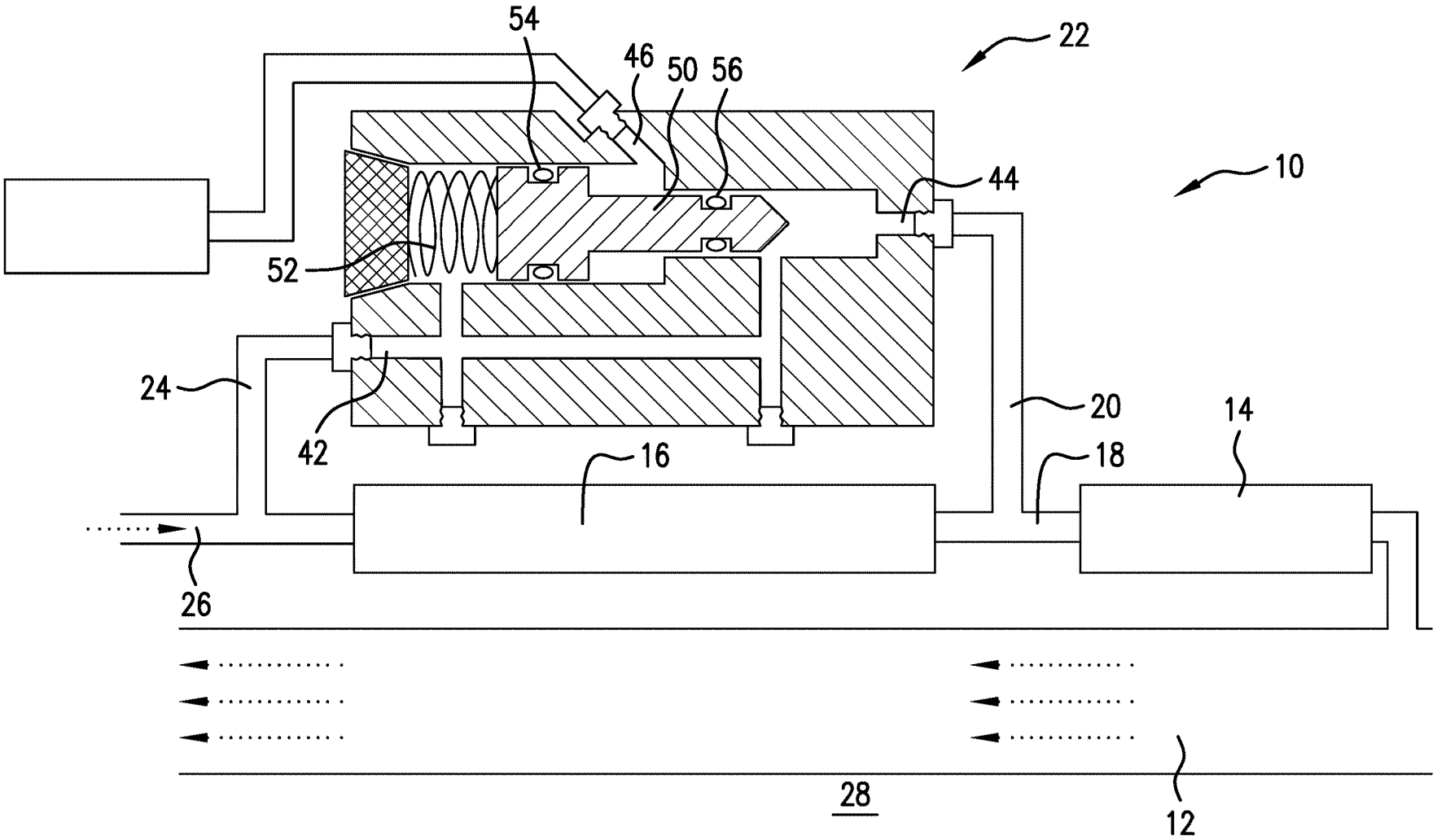
FIG. 2 is an illustration of an embodiment of the injection valve arrangement showing one bypass switch configuration.

Referring to FIG. 2, an embodiment of arrangement 10 that automatically responds to tubular or annulus pressure is illustrated. In this embodiment, switch 22 comprises a housing 40 having an injection fluid inlet 42, an injection fluid outlet 44 and a switch control conduit 46. The housing defines a piston chamber 48 within which a piston 50 is movably disposed. The piston 50 is biased to a closed position by a biasing member 52 and can be held in the open position through the application of a threshold pressure in conduit 46. In the open position (as illustrated), fluid may flow from inlet 42 to outlet 44 enabling the bypass pathway 8. An embodiment configures piston 50 with differential piston areas with seals 54 and 56 to ensure movement in the desired direction. In embodiments, the conduit 46 is fluid pressure communicated to tubing or annulus pressure. Pressure communication may be through control line, passageway, etc. Using one of these sources of triggering pressure causes the arrangement to be essentially automatic with regard to whether the bypass is open or closed. Specifically, the bypass will be open during times when the pressure in the tubing or annulus is sufficiently high to overcome the biasing member 52. This condition occurs when the well is earlier in its life and the formation accordingly has a higher pressure level. This is precisely when it is desirable to have the switch 22 open. When the pressure in the tubing or annulus is lower however, usually when the well is near end of life and the formation pressure is depleted, the switch 22 will close under the influence of the biasing member 52 thereby preventing injection fluids from dumping into the well. It is of course possible to connect conduit 46 to any other pressure source including one that is controllable from surface such as a control line (not shown).

Figure 3:
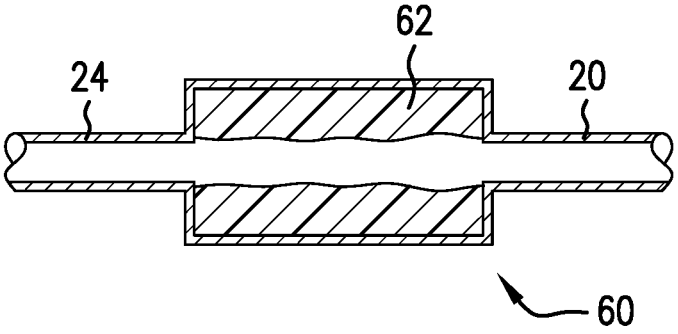
FIG. 3 is an illustration of another bypass switch configuration.

Referring to FIG. 3, an alternate embodiment of the switch 22 is illustrated and labeled switch 60. In this embodiment, the switch 60 comprises a swellable material 62. The material selected is one that will remain in the unswelled condition until a trigger fluid is applied thereto in the form of a pill. In this embodiment, an operator will monitor pressure in the well and take action to close the switch 60 and thereby the bypass pathway (by sending a pill of trigger fluid) at a time prior to wellbore or formation pressures going below the injection fluid hydrostatic column pressure.

Figure 4:
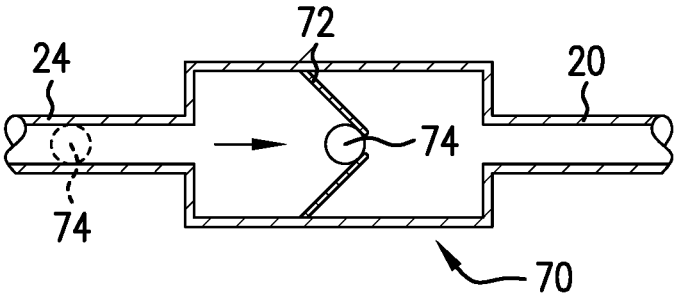
FIG. 4 is an illustration of yet another bypass switch configuration.

Referring to FIG. 4, yet another embodiment is illustrated for switch 22. In this embodiment the switch 22 is labeled switch 70 and comprises an object seat 72 therein that allows fluid to pass through the bypass pathway until an object 74, such as a small ball or dart, etc. is permitted to move toward the seat 72 and become seated thereon, preventing further flow therepast. The object 74 may be dropped from surface or from an object housing somewhere upstream of the seat 72 for release at will or upon sensing of conditions that dictate the bypass pathway should be closed. Regarding the latter, it is contemplated herein for all embodiments that sensors may be included to monitor pressure or flow rate and/or direction, the information obtained from the sensors being employed to automatically or through manual action to alter the flow conditions through the arrangement 10.

Set forth below are some embodiments of the foregoing disclosure:

Embodiment 1: An injection arrangement including a principal fluid pathway having a first check valve; a bypass pathway fluidly connected to the principal fluid pathway upstream of the first check valve and connected to the principal fluid pathway downstream of the first check valve.

Embodiment 2: The injection arrangement as in any prior embodiment wherein the principal fluid pathway includes a second check valve.

Embodiment 3: The injection arrangement as in any prior embodiment wherein the bypass pathway is connected to the principal fluid pathway between the check valve and the second check valve.

Embodiment 4: The injection arrangement as in any prior embodiment wherein the bypass pathway includes a switch having conditions in which fluid flow is permitted in the bypass pathway and in which fluid flow is prevented in the bypass pathway.

Embodiment 5: The injection arrangement as in any prior embodiment wherein the switch is responsive to a pressure source.

Embodiment 6: The injection arrangement as in any prior embodiment wherein the pressure source is tubing or annulus pressure.

Embodiment 7: The injection arrangement as in any prior embodiment wherein the switch includes a piston that is responsive to pressure to connect a fluid inlet to a fluid outlet.

Embodiment 8: The injection arrangement as in any prior embodiment wherein the piston includes two seals with a differential area.

Embodiment 9: The injection arrangement as in any prior embodiment wherein the switch comprises a swellable material.

Embodiment 10: The injection arrangement as in any prior embodiment wherein the swellable material when swelled blocks fluid flow.

Embodiment 11: The injection arrangement as in any prior embodiment wherein the switch comprises an object seat receptive to an object to prevent flow past the seat.

Embodiment 12: A method for injecting a fluid including supplying an injection fluid to an injection arrangement as in any prior embodiment; flowing fluid through the bypass pathway; preventing fluid flow through the bypass pathway; and then flowing fluid through the principal fluid pathway.

Embodiment 13: The method as in any prior embodiment wherein the preventing is by closing a switch.

Embodiment 14: The method as in any prior embodiment wherein the closing is automatic upon pressure drop in a triggering pressure.

Embodiment 15: The method as in any prior embodiment wherein the closing is by swelling a swellable material within the bypass pathway.

Embodiment 16: The method as in any prior embodiment wherein the closing is by dropping an object to a seat within the bypass pathway.

Embodiment 17: A wellbore including a tubing within a borehole in a subsurface formation; and an injection arrangement as in any prior embodiment.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An injection arrangement comprising:

a principal fluid pathway having a first check valve configured to prevent a loss of injection fluid and a second check valve configured to prevent infiltration of wellbore fluids into the injection arrangement; and a bypass pathway fluidly connected to the principal fluid pathway upstream of the first check valve and connected to the principal fluid pathway downstream of the first check valve, the bypass pathway including a switch actuated by an input that is different from the principal fluid pathway pressure to prevent or allow fluid flow through the bypass pathway.

2. The injection arrangement as claimed in claim 1 wherein the bypass pathway is connected to the principal fluid pathway between the first check valve and the second check valve.

3. The injection arrangement as claimed in claim 1 wherein the switch is responsive to a pressure source.

4. The injection arrangement as claimed in claim 3 wherein the pressure source is tubing or annulus pressure.

5. The injection arrangement as claimed in claim 1 wherein the switch comprises a swellable material.

6. The injection arrangement as claimed in claim 5 wherein the swellable material when swelled blocks fluid flow.

7. The injection arrangement as claimed in claim 1 wherein the switch comprises an object seat receptive to an object to prevent flow past the seat.

8. A method for injecting a fluid comprising:

supplying the injection fluid to an injection arrangement as claimed in claim 1;

flowing fluid through the bypass pathway;

preventing fluid flow through the bypass pathway; and then flowing fluid through the principal fluid pathway.

9. The method as claimed in claim 8 wherein the preventing is by closing the switch.

10. The method as claimed in claim 9 wherein the closing is automatic upon pressure drop in a triggering pressure.

11. The method as claimed in claim 9 wherein the closing is by swelling a swellable material within the bypass pathway.

12. The method as claimed in claim 9 wherein the closing is by dropping an object to a seat within the bypass pathway.

13. A wellbore comprising:

a tubing within a borehole in a subsurface formation; and the injection arrangement as claimed in claim 1.

14. An injection arrangement comprising:

a principle fluid pathway having a first check valve; and a bypass pathway fluidly connected to the principal fluid pathway upstream of the first check valve and connected to the principal fluid pathway downstream of the first check valve wherein the bypass pathway includes a switch having conditions in which fluid flow is permitted in the bypass pathway and in which fluid flow is prevented in the bypass pathway and wherein the switch is actuated by an input that is different from the principal fluid pathway pressure to connect a fluid inlet to a fluid outlet.

15. The injection arrangement as claimed in claim 14 further including a piston wherein the piston includes two seals placed at different locations on the piston wherein those locations of the piston have different cross-sectional areas compared to each other.

* * * * *